US006398271B1

(12) United States Patent
Tomaszewski et al.

(10) Patent No.: US 6,398,271 B1
(45) Date of Patent: Jun. 4, 2002

(54) CONTROL ASSEMBLY FOR LIFT GATE OR SLIDING AND CARGO DOORS

(75) Inventors: Kris Tomaszewski, Markham; Grzegorz H. Baniak, Etobicoke, both of (CA); Gregory A. Jorgensen, Oxford, MI (US)

(73) Assignee: Atoma International Corp., Newmarket (CA)

( * ) Notice: Subject to any disclaimer, the term of this patent is extended or adjusted under 35 U.S.C. 154(b) by 0 days.

(21) Appl. No.: 09/403,830

(22) PCT Filed: Apr. 29, 1998

(86) PCT No.: PCT/CA98/00400

§ 371 (c)(1),
(2), (4) Date: Jan. 31, 2000

(87) PCT Pub. No.: WO98/49417

PCT Pub. Date: Nov. 5, 1998

(30) Foreign Application Priority Data

Apr. 29, 1997 (CA) ..... 2203973

(51) Int. Cl.[7] ..... E05C 3/06
(52) U.S. Cl. ..... 292/216; 292/201
(58) Field of Search ..... 292/336.3, 216, 292/201, DIG. 23

(56) References Cited

U.S. PATENT DOCUMENTS

| | | | | |
|---|---|---|---|---|
| 3,563,589 A | | 2/1971 | Kwasiborski, Jr. | |
| 3,672,713 A | | 6/1972 | Pickles | |
| 4,157,844 A | | 6/1979 | Sarosy et al. | |
| 4,334,704 A | | 6/1982 | Yamada | |
| 4,455,042 A | | 6/1984 | Yamada | |
| 4,995,653 A | * | 2/1991 | Torii | 292/216 |
| 5,035,449 A | | 7/1991 | Shiratori et al. | |
| 5,040,390 A | | 8/1991 | Mistry et al. | |
| 5,174,619 A | | 12/1992 | Bender et al. | |
| 5,234,237 A | | 8/1993 | Gregoe et al. | |
| 5,308,130 A | | 5/1994 | Lee | |
| 5,438,855 A | | 8/1995 | Ikeda | |
| 5,474,338 A | | 12/1995 | Buscher | |
| 5,516,167 A | * | 5/1996 | Hayakawa | 292/201 |
| 5,582,444 A | | 12/1996 | Hayakawa et al. | |
| 5,605,363 A | | 2/1997 | Kapes | |
| 5,622,396 A | | 4/1997 | Neumann | |

FOREIGN PATENT DOCUMENTS

| | | |
|---|---|---|
| DE | 3902873 | 2/1990 |
| DE | 3923726 | 1/1991 |
| DE | 4312344 | 7/1994 |
| DE | 4440839 | 5/1995 |
| EP | 0775791 | 9/1996 |
| EP | 0826855 | 3/1997 |
| GB | 2295643 | 2/1996 |

* cited by examiner

*Primary Examiner*—Gary Estremsky
(74) *Attorney, Agent, or Firm*—Howard & Howard

(57) ABSTRACT

A control assembly for releasing a latch has a base plate (26) for mounting components of the control assembly. A pivotally mounted (28) input lever is movable between a ready position and a release position. The input lever (28) connects to a release handle (22). A pivotally mounted output lever (30) connects to a latch (14, 16) and transmits a releasing force. A pivotally mounted locking lever (34) is rotatable between a locked position and an unlocked position. A link (98) slidably engages the output lever (30) and pivotally engages the locking lever (34). When the locking lever (34) moves between the locked and unlocked positions, the link (98) responsively decouples and couples the input lever (28) and the output lever (30) to allow independent and dependent rotation thereof, respectively, selectively transferring the releasing force from the release handle (22) to the latch (14, 16).

15 Claims, 3 Drawing Sheets

CONTROL ASSEMBLY FOR LIFT GATE OR SLIDING AND CARGO DOORS

FIELD OF INVENTION

This invention relates to closure members for vehicles which close a compartment such as a tailgate, a cargo door, or a sliding door or the like. The door is typically moved, for example pivoted or slid from a closed position to an open position. In order to effect this movement, a handle must be operated through a control assembly to release the latch mechanisms allowing the closure to be moved to the open position. This present invention finds particular application therefore in providing such a control assembly which has simplified the structures heretofore known reducing the number of parts thereof and increasing the reliability thereof while reducing the overall power consumption required in a preferably power actuated control assembly.

BACKGROUND OF INVENTION

Within the prior art there exists a number of structures for releasing a closure such as a tailgate. For example, U.S. Pat. No. 5,531,498, as one example, refers to a power lift-type tailgate and includes a control assembly which is cable driven once the latches are released. The drive includes a motor driving a cable reel to lift the tailgate assembly.

Other designs are also known, which designs have been installed on the lift gates of certain production vehicles. These designs include an actuator which converts linear motion to a rotary motion for the locking lever, and then through the two-position floating pin to a further linear motion of the floating pin to a rotary motion for the output lever to a further linear motion for the cable release. A significant amount of friction therefore is developed, and hence friction loss is experienced as a result of utilizing such a system. Incorporated with the locking lever is a two-position over center toggle spring which allows the two positions attained by the floating pin. The locking lever has an emergency manual override tab which may be accessed should the actuator fail. Therefore, when the input lever is operated by a handle connected to the control via a rod or a cable, the input arm of the input lever will engage the floating pin and therefore allow release of the latches. Should the floating pin however be moved via the operation of the locking lever to the inoperative position, then the input arm of the input lever will not be able to access the floating pin, and hence the output lever will not operate in spite of the fact that the input lever will operate. Such a control assembly therefore includes a first pivot connected to the locking lever, a second pivot connected with the floating pin, a third pivot about which the locking lever pivots, and a fourth pivot about which the input lever and the output lever pivot. Within the actuator itself, it is estimated that the electrical requirements would be approximately 10 watts normally, and peak at approximately 50 watts or more, with up to 5 amps being drawn by the motor.

Clearly therefore, the problems can be seen in providing such a device in that a significant amount of the power utilized by the actuator goes into friction losses when transferring the power from the actuator to the actual cables. Secondly, the reliability of the product must be questioned in that many of the parts, for example such as the tab from the locking lever which accesses the opening of the linear actuator plunger, undergoes a dynamic load over each cycle and may tend to fail in time. Secondly, the pivot for the locking lever may tend to bind in time, or the floating pin may also bind within the slot between its two positions.

SUMMARY OF THE INVENTION

The disadvantages of the prior art may be overcome by providing a latch control assembly having a simple mechanism for locking and unlocking a lift gate or door and for effecting unlatching thereof.

According to one aspect of the invention, there is provided a control assembly for releasing a latch. The control assembly has a base plate for mounting components of the control assembly. A pivotally mounted input lever is movable between a ready position and a release position. The input lever connects to a release handle. A pivotally mounted output lever connects to a latch and transmits a releasing force. A pivotally mounted locking lever is rotatable between a locked position and an unlocked position. A link slidably engages the output lever and pivotally engages the locking lever. When the locking lever moves between the locked and unlocked positions, the link responsively decouples and couples the input lever and the output lever to allow independent and dependent rotation thereof, respectively, selectively transferring the releasing force from the release handle to the latch.

DESCRIPTION OF THE DRAWINGS

In drawings which illustrate an embodiment of the invention.

DESCRIPTION OF THE INVENTION

Figure 1:
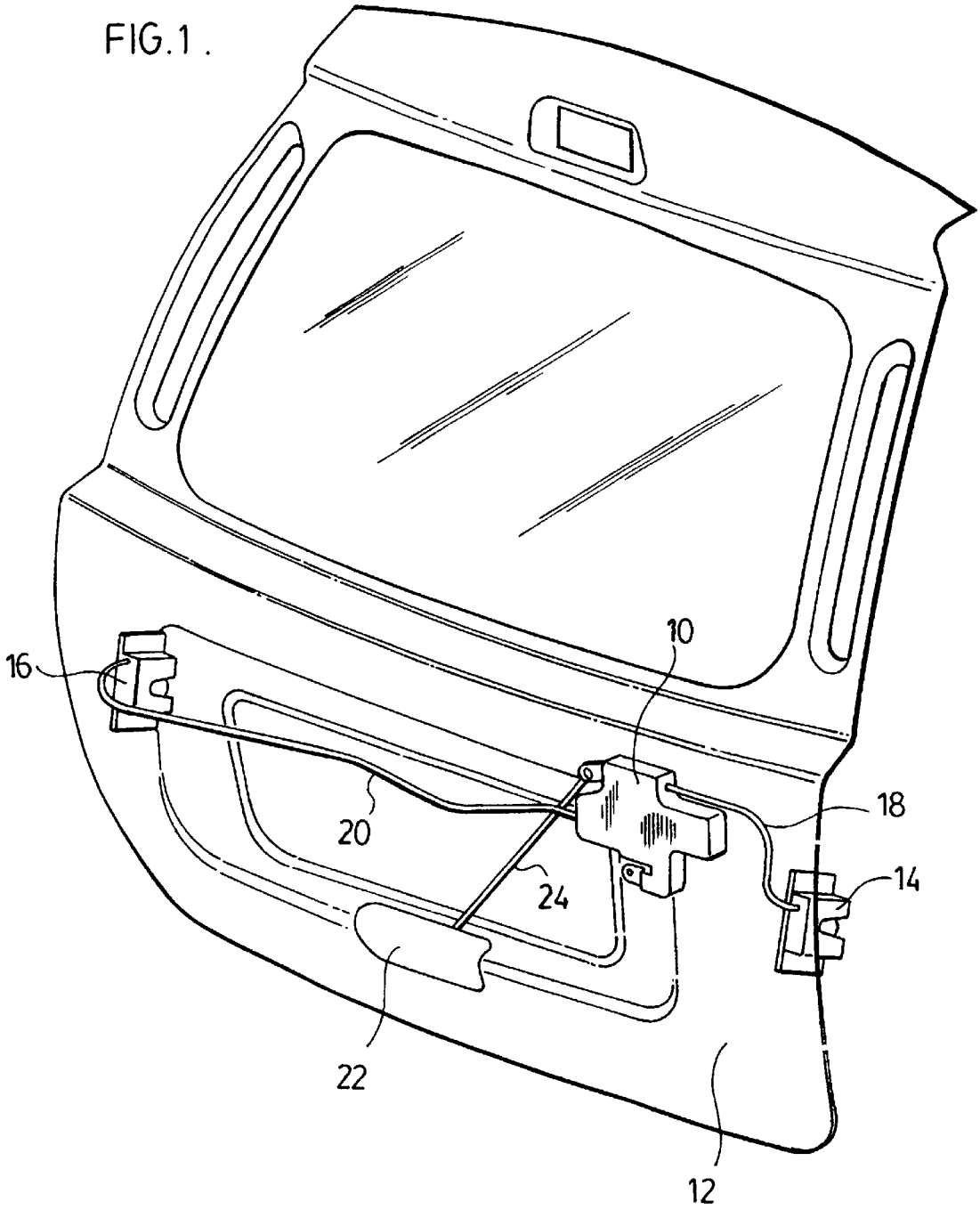
FIG. 1 is a perspective view of lift gate incorporating the control assembly of the present invention.

Referring now to FIG. 1, there is illustrated a tailgate assembly or door assembly 12, normally pivotally mounted, which allows the door 12 to swing upwardly in the conventional motion of a tailgate. Two latches, 14 and 16 are conveniently located proximate the sides of the tailgate 12 which will engage keepers or strikers when the tailgate 12 is closed. The latches 14, 16 are oriented in such a way that the fish mouths will each engage with the respective strikers as is well known in the art. The latches 14, 16 are conventional and include pawl release levers to which are connected the Bowden cables 18, 20 for each latch. The Bowden cables 18, 20 are conveniently run through clips in openings in the body panels which allow motion of the cable and yet securement of the cable in relation to the panel. The Bowden cables 18, 20 operatively connect to the control assembly 10 of the present invention. Release handle 22 is operatively connected via a cable or rod 24 to the input lever of control assembly 10. Release handle 22 is pivotally mounted to the tailgate 12 in a manner conventional in the art. Actuation of the release handle 22 effects the release of the latches 14, 18 when the control assembly 10 is in the operative or unlocked position which will be described hereinafter.

Figure 2:
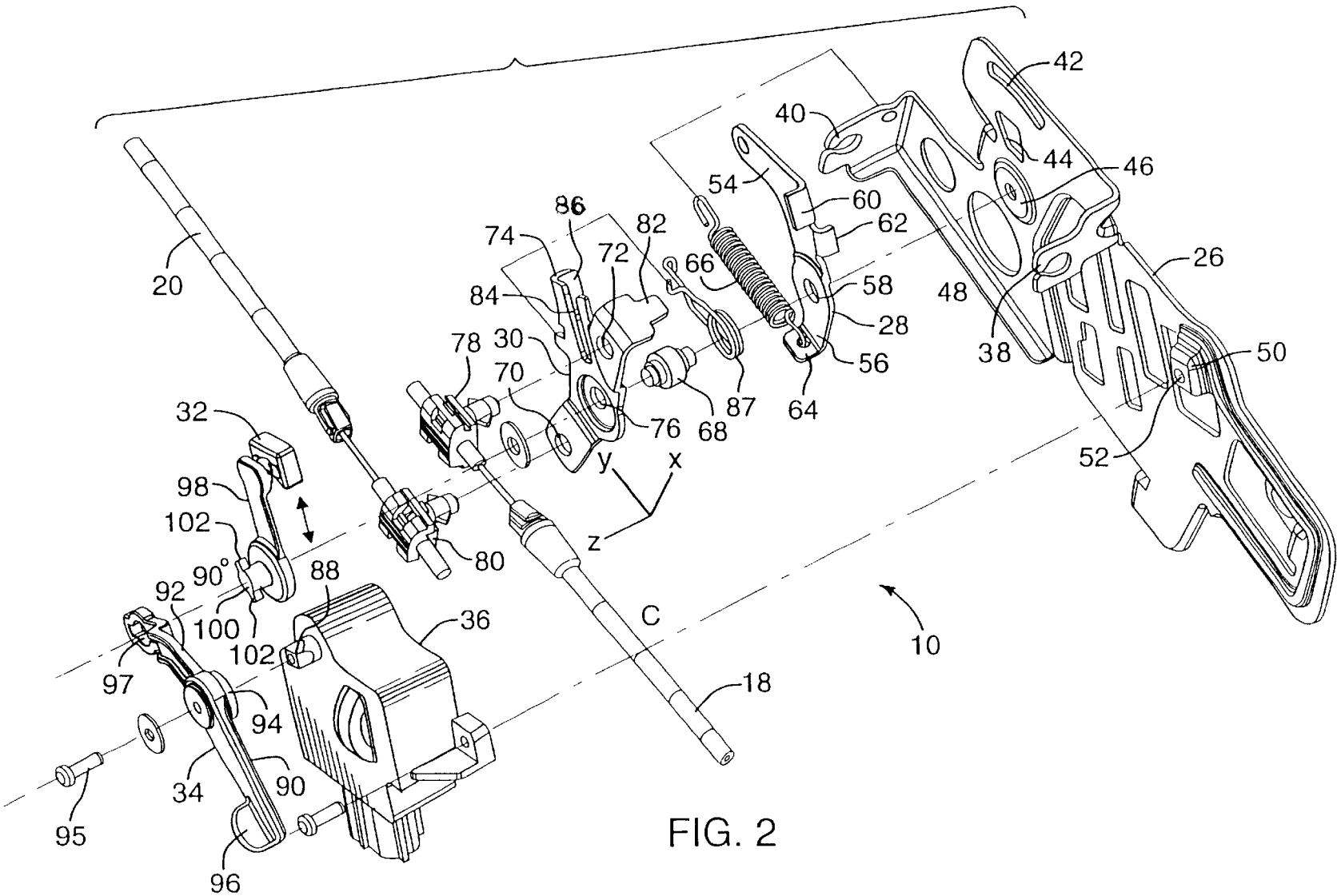
FIG. 2 is an exploded view of the control assembly of the present invention.

Referring now to FIG. 2, there is illustrated the control assembly 10 which includes a mounting or base plate 26, an input lever 28, an output lever 30, a locking block 32, a locking lever 34 and an actuator 36.

Base plate 26 is preferably a stamped metal formed with various features including mounting holes, Bowden cable attachment tabs 38, 40, an arcuate guide slot 42, and a control window 44. Tabs 38, 40 extend generally perpendicular from base plate 26. Tabs 38 and 40 have cutouts for receiving the outer cable shell or sheath of Bowden cables 18, 20. Base plate 26 has an embossed area 46 having a bore 48 and an embossed area 50 having a bore 52. Base plate 26 is otherwise configured for mounting the components of the control assembly 10 onto the base plate 26 and for matching the footprint for mounting the control assembly 10 onto the frame of the lift gate 12.

Input lever 28 is preferably a stamped metal and formed to be pivotally mounted onto base plate 26. Input lever 28 has two arms 54, 56 extending from opposite sides of pivot 58. Ann 54 has tabs 60, 62 extending in opposite directions. Tab 62 extends towards the base plate 26 and extends through control window 44. Control window 44 limits the pivotal travel of the input lever 28 between a ready position and a release position. Arm 56 has a tab 64 having an aperture for receiving spring 66. Spring 66 extends between tab 40 and tab 64 to bias the input lever 28 to the ready position.

Output lever 30 is preferably a stamped metal and formed to be pivotally mounted onto base plate 26 coaxially with input lever 28. Output lever 30 is mounted on pivot pin 68 which pivotally mounts input lever 28 through bore 48 on base plate 26. Output lever 30 has three arms 70, 72 and 74. Arms 70, 72, 74 extend radially from a central pivot 76 through which pivot pin 68 extends. Arms 70, 72 are preferably diametrically opposed. The distal ends of arms 70, 72 each has a bore for receiving clips 78, 80 in a snap fit. Clips 78 and 80 are connected to the ends of cables 18, 20, respectively. Pivotal movement of output lever 30 will simultaneously extend and retract each of cables 18, 20 for release of latches 14, 16. Arm 72 has a tab 82 at the distal end, which tab extends through guide slot 42 on base plate 26. Guide slot 42 limits pivotal travel of the output lever 30. Arm 74 has a radially extending slot 84 and a cooperating axially extending flange 86. Spring 87 extends between arm 74 and the base plate 26 to bias the output lever 30 to a position, wherein the cables 18, 20 will be at an unextended length or retracted position.

The locking lever 34 is preferably a stamped metal component and formed to be drivingly mounted on output shaft 88 of actuator 36. Locking lever has two arms 90, 92 extending from a central core 94. Core 94 has an aperture complementary to the shape of output shaft 88 for a driving engagement therewith. A screw 95 attaches the locking lever 34 to the output shaft 88. Arm 90 has a tab 96 at the distal end. Arm 92 has a keyway aperture 97 for pivotally connecting with link 98 of locking block 32. Connecting link 98 has, at one end, pin 100 having locking tabs 102 and locking block 32 at the opposite end. Locking block 32 is pivotally connected to and slightly spaced from the connecting link 98. The locking tabs 102 can be inserted into keyway aperture 97 to pivotally connect the connecting link 98 to the locking lever 34. The locking block 32 engages the output lever 30. Specifically the mounting pin of the locking block 32 will be inserted through slot 84 of output lever 30. Locking block 32 will slide against flange 86. Rotation of locking lever 34 will cause the locking block 32 to slide in the slot 84 between an operative or unlocked position wherein the locking block 32 will extend between the flange 86 and the tab 60 of input lever 28 and an inoperative or locked position wherein the locking block 32 does not engage tab 60 of input lever 28. In the embodiment illustrated, the operative position is radially outward and the inoperative or locked position is radially inward along slot 84.

Actuator 36 is conventional in design. In one embodiment of the invention, a motor drives output shaft 88 through a series of gears (not illustrated) to rotate locking lever 34 between a locked position and an unlocked position.

Figure 3:
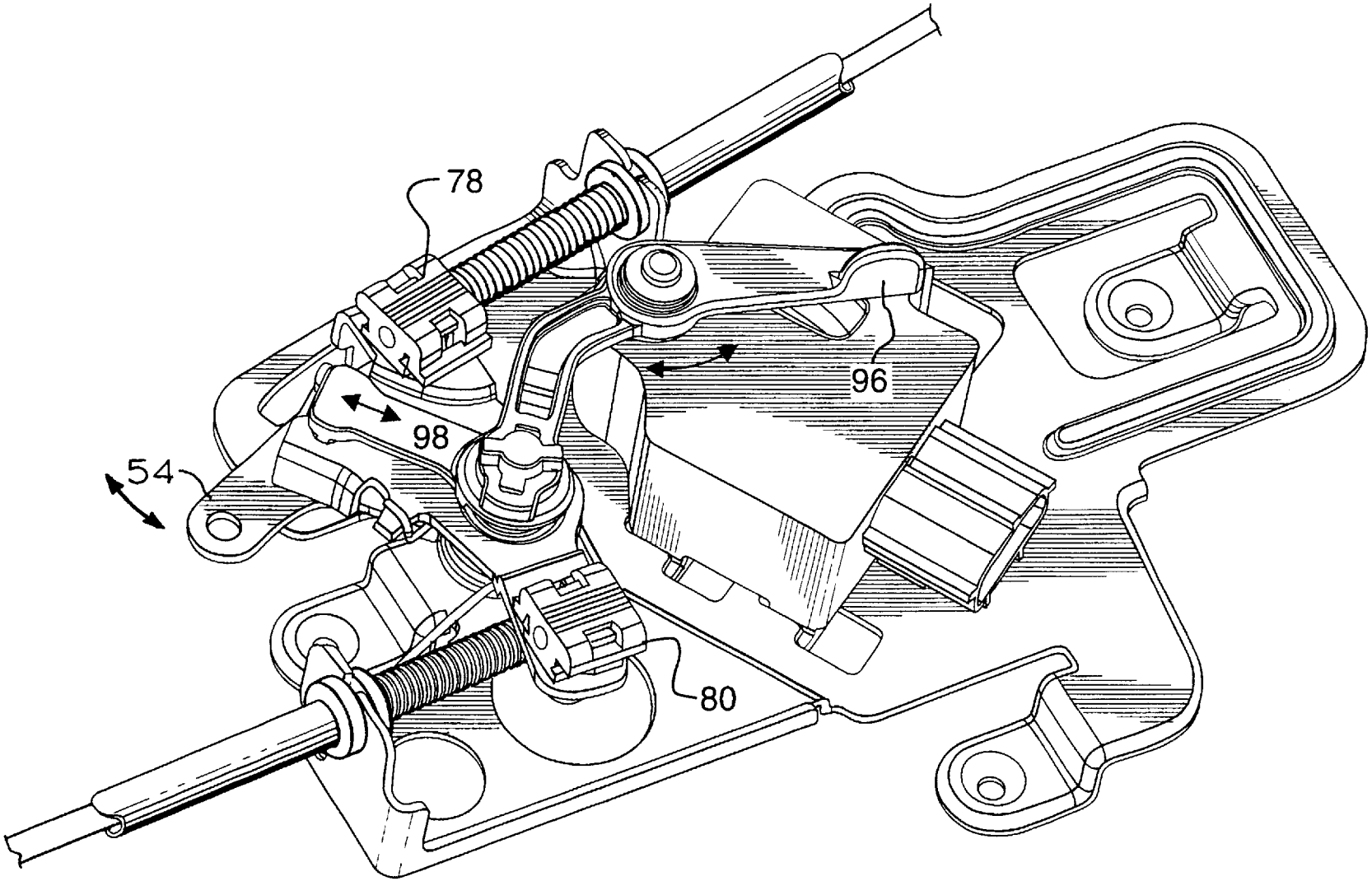
FIG. 3 is a perspective view of the control assembly of FIG. 2.

Referring now to FIG. 3, the locking block 32 moves linearly along the slot 84. When the locking block 32 is in the operative or unlocked position, movement of the input lever 28 will translate to the output lever 30 through the locking block 32, so that the input lever 28 is coupled to the output lever 30 to rotate dependently. However, when the locking block 32 travels radially inwardly to the disengaged or locked position, the operative connection between the input lever 28 and the output lever 30 is removed. Input lever 28 is uncoupled from the output lever 30 to rotate independently. Should the handle 22 be utilized and the input lever 28 rotated, the input lever 28 will merely freely move on its pivot without moving any of the other components of the control assembly 10. Further, the locking lever 34 has an emergency manual override tab 96 which may be accessed should the actuator 36 fail, or alternatively in another embodiment, when the actuator is not present, be in communication with a manually operable user accessible device such as a knob or the like or alternatively in communication with a child proofing lever.

In operation therefore, the actuator 26 or user accessible operator would be operated or powered via a push button, knob, a remote or the like causing the rotation of the locking lever 34 about its pivot, and therefore cause the linear motion of the locking block 32 relative to arm 74 of the output lever 30, moving the locking block 32 in and out of operative interconnection between the input lever 28 and the output lever 30 to couple and uncouple the input lever 28 and the output lever 30. Therefore, when the locking block 32 is in the operative or unlocked position, the actuating tab 60 of the input lever 28 will engage the locking block 32 adjacent thereto which in turn will transmit any force transmitted through the input lever 28 to the flange 86 of the output lever 30 causing the output lever 30 to rotate upon its pivot to allow for the release of the latches 14, 16 as the cables 18, 20 are retracted responsive to the output lever 30 rotation. However, when the locking block 32 is translated to the disengaged or locked position, whereat the tab 60 can no longer engage the locking block 32, regardless of movement of the handle 22 and input lever 28, the latches 14, 16 cannot release.

The invention has been described in an illustrative manner with respect to the preferred embodiments thereof, and it is understood and implied that the terminology that has been used is intended to be for descriptive purposes only and not for the interpretation in limiting the invention. As many changes can be made to the preferred embodiments of the invention without departing from the scope thereof; it is intended that all matter contained herein be considered illustrative of the invention and not in a limiting sense.

We claim:

1. A control assembly for releasing a latch, said control assembly comprising;

a base plate for mounting components of the control assembly, a pivotally mounted input lever movable between a ready position and a release position, the input lever constructed and arranged to be connected to a release handle, a pivotally mounted output lever constructed and arranged to be connected to a latch and to transmit a releasing force therethrough, said output lever having a radially extending slot, a pivotally mounted locking lever rotatable between a locked position and an unlocked position, a link slidably engaging said radially extending slot of said output lever and pivotally engaging said locking lever, wherein when said locking lever moves between the locked and unlocked positions, the link responsively decouples and couples the input lever and the output lever to allow independent and dependent rotation thereof, respectively, selectively transferring the releasing force from the release handle to the latch, characterized by said link having a locking block in sliding engagement with the output lever, said locking block juxtaposes a flange on the output lever and a tab on the input lever when the input lever and the output lever are coupled together and disengages from at least one of the flange and the tab when the input lever and the output lever are uncoupled.

2. A control assembly as claimed in claim 1 wherein said input lever and said output lever are commonly mounted.

3. A control assembly as claimed in claim 1 wherein said output lever has a radially extending arm constructed and arranged to receive a bowden cable operatively connected to the latch and said base plate has a bracket for retaining a sheath of the bowden cable.

4. A control assembly as claimed in claim 3 wherein said output lever has a second radially extending arm having a slot for slidable receiving said link.

5. A control assembly as claimed in claim 4 wherein said input lever and said output lever are commonly mounted.

6. A control assembly as claimed in claim 1 wherein said control assembly further comprises an actuator and the locking lever is mounted on said actuator for drivingly effecting said pivotal movement.

7. A control assembly as claimed in claim 6 wherein said output lever has a radially extending arm constructed and arranged to receive a bowden cable operatively connected to the latch and said base plate has a bracket for retaining a sheath of the bowden cable.

8. A control assembly as claimed in claim 7 wherein said output lever has a second radially extending arm having a slot for slidable receiving said link.

9. A control assembly as claimed in claim 8 wherein said input lever and said output lever are commonly mounted.

10. A control assembly as claimed in claim 9 wherein said locking lever is constructed and arranged to be manually operated.

11. A control assembly as claimed in claim 10 wherein said control assembly simultaneously effects release of at least two latches.

12. A control assembly as claimed in claim 11 wherein said output lever has a plurality of radially extending arms, at least two of said arms constructed and arranged to receive a bowden cable operatively connected to each of said at least two latches and said base plate has a bracket for retaining a sheath of each of said bowden cables.

13. A control assembly as claimed in claim 12 wherein one of said arms has a slot for slidable receiving said link.

14. A control assembly as claimed in claim 13 wherein said input lever and said output lever are commonly mounted.

15. A control assembly as claimed in claim 14 wherein said locking lever is constructed and arranged to be manually operated.

* * * * *